US006442836B1

(12) United States Patent
Chen et al.

(10) Patent No.: US 6,442,836 B1
(45) Date of Patent: Sep. 3, 2002

(54) METHOD OF MAKING FOLDED FIN

(75) Inventors: Yu Ping Chen, Kaohsiung; Kuo Chuan Lin, Pan-Chiao; Chao-Kun Tseng, Tu-Chen, all of (TW)

(73) Assignee: Foxconn Precision Components Co., Ltd., Taipei Hsien (TW)

( * ) Notice: Subject to any disclaimer, the term of this patent is extended or adjusted under 35 U.S.C. 154(b) by 0 days.

(21) Appl. No.: 09/706,140

(22) Filed: Nov. 3, 2000

Related U.S. Application Data

(62) Division of application No. 09/218,725, filed on Dec. 22, 1998, now Pat. No. 6,195,874.

(51) Int. Cl.[7] ..... B21D 53/02

(52) U.S. Cl. ..... 29/890.03; 29/727; 29/726; 72/295; 72/383

(58) Field of Search ..... 29/890.03, 890.053, 29/726, 727, 33 G, 33 S; 72/187, 379.2, 295, 383, 301, 384, 385, 379.6

(56) References Cited

U.S. PATENT DOCUMENTS 3,137,337 A * 6/1964 Ungerer
3,258,832 A * 7/1966 Gerstung
5,197,318 A * 3/1993 Joyce et al.
5,732,460 A * 3/1998 Paternoster et al.
6,321,584 B1 * 11/2001 Chen et al.

* cited by examiner

*Primary Examiner*—Icuda Rosenbaum
*Assistant Examiner*—T. Nguyen
(74) *Attorney, Agent, or Firm*—Wei Te Chung

(57) ABSTRACT

A method for forming a folded fin includes at least the following steps: providing a horizontal metallic strip; forming number of pairs of indents alternately in a top face and a bottom face of the strip; clamping the strip with three folding tools, wherein a first tool is located between a first pair of indents in the top face of the strip, a second tool is located between a successive second pair of indents in the bottom face of the strip and a third tool is located between a fuirther successive third pair of indents in the top face of the strip; and moving the second and third tools toward the first tool to a position where parts of the strip between the first and second tools and between the second and third tools are bent to be vertical, wherein the third tool moves horizontally toward the first tool and the second tool moves at an angle toward an upper side of the first tool.

3 Claims, 20 Drawing Sheets

METHOD OF MAKING FOLDED FIN

CROSS REFERENCE TO RELATED APPLICATION

This is a Division of U.S. patent application Ser. No. 09/218,725, filed on Dec. 22, 1998, now is U.S. Pat. No. 6,195,874, which is now pending.

BACKGROUND OF THE INVENTION

1. Field of the Invention

The present invention relates to a folded fin forming method, machine and folded fin obtained therefrom. The folded fin has a corrugated configuration and is particularly used in constructing a heat sink for dissipating heat generated by Integrate Circuits (ICs).

2. The Prior Art

Due to the increased consumption of power of ICs (particularly Central Processing Units (CPUs)), heat dissipation of these electronic components is becoming increasingly important. To solve this problem, heat sinks are mounted to contact the CPUs to absorb heat generated thereby and dissipate it into the surrounding air.

Referring to FIG. 1, a conventional heat sink 10 is constructed by alumium extrusion to have a number of heat dissipating fins 12. The heat sink 10 formed by this method is costly.

To lower the cost, a folded fin 22 having a corrugated configuration is made by stamping or roll forming a metal sheet (usually an aluminum sheet), as seen in FIG. 2. The folded fin 22 consists of a number of inverted U-shaped heat dissipating fins 23 and is fixed to a flat base plate 24 by epoxy or riveting to form a heat sink 20.

The heat sinks 10, 20 made in accordance with the prior art share a common disadvantage. Each of the heat dissipating fin 12, 23 cannot have an aspect ratio (H/W) larger than twelve, otherwise breakage of the fins 12, 23 will occur during manufacture of the heat sink 10 or the folded fin 22. The limited aspect ratio of the fins 12, 23 limits the available heat dissipating area per length unit of the heat sink 10, 20.

Moreover, referring to FIG. 3, in order to enhance the heat dissipating effectiveness of the folded fin 22, when producing the folded fin 22 by roll forming, a number of louvers 252 are defined in webs 25 of the heat dissipating fins 23. Due to the limitation of the forming direction of he roll forming, the louvers 252 can only be vertically defined in the webs 25. Although the louvers 252 can increase the heat dissipating area of the folded fin 22, the direction of arrangement of the louvers 252 is perpendicular to the direction of forced air flow through the heat sink. Thus, the enhanced effectiveness achievable by the provision of the louvers 252 is not as significant as horizontal louvers.

Hence, an improvement over the prior art heat sink is needed.

SUMMARY OF THE INVENTION

Accordingly, an objective of the present invention is to provide a method for forming a folded fin with a number of inverted U-shaped heat dissipating fins which can have an unlimited aspect ratio without breakage of webs thereof occurring during formation of the folded fin.

Another objective of the present invention is to provide a machine for forming a folded fin with a number of inverted U-shaped heat dissipating fins which can have an unlimited aspect ratio without breakage of the webs thereof occurring during formation of the folded fin.

A further objective of the present invention is to provide a folded fin with a number of inverted U-shaped heat dissipating fins each having an aspect ratio larger than twelve and preferably between twenty and forty.

Still another objective of the present invention is to provide a method for forming a folded fin with a number of inverted U-shaped heat dissipating fins each of which has right-angled comers so that when the folded fin is attached to a metallic base plate, a maximum contacting area exists therebetween.

Still a further objective of the present invention is to provide a method for forming a folded fin with a number of inverted U-shaped heat dissipating fins each defining a number of horizontal louvers in webs thereof (or wave-like structures having horizontal peaks) so that the heat dissipating effectiveness of the folded fin can be significantly enhanced.

To fulfill the above-mentioned objectives, according to one embodiment of the present invention, a method for forming a folded fin includes the following steps:

providing a horizontal metal strip;

forming a number of pairs of indents alternately in top and bottom faces of the strip;

clamping the strip with three folding tools, wherein a first tool clamps the strip between a first pair of indents in the top face of the strip, a second tool clamps the strip between a successive second pair of indents in the bottom face of the strip, and a third tool clamps the strip between a fuirther successive third pair of indents in the top face of the strip; and moving the second and third tools toward the first tool to fold the strip to position where sections of the strip between the first and second tools, and the second and third tools are vertically bent, wherein the third tool moves horizontally toward the first tool and the second tool moves at an angle toward an upper side of the first tool.

A machine for forming the folded fin consists of a stationary frame, a folding tool carrier horizontally and reciprocally mounted on the frame, three folding tools carried by the carrier for folding a horizontal strip inserted in the machine into the folded fin, and a locating device for fixing the horizontal metal strip relative to the frame when the folding tools do not clamp the strip.

After he horizontal strip has been received in the machine, the three folding tools securely clamp the strip at an original position. The carrier horizontally displaces the three folding tools together with the strip a predetermined distance toward the first tool. Thereafter, the second tool moves at an angle toward an upper side of the first tool and the third tool moves horizontally toward the first tool to reach a position where sections of the strip between the first and second tools, and the second and third tools are vertically bent, thereby forming an inverted U-shaped heat dissipating fin. The locating device is driven to fix the strip relative to the frame. The three folding tools are released from the strip and the carrier displaces the folding tools a predetermined distance toward the third folding tool. The three folding tools return to their respective original positions and securely clamp the strip. Afterwards, the above operation is repeated to form successive inverted U-shaped heat dissipating fins on the strip thereby obtaining the folded fin.

In the machine according to the present invention, the three folding tools are spaced from each other a distance D when they are at the original position which is substantially equal to a height H of the formed inverted U-shaped heat dissipating fin (H=D+2t, t: thickness of the strip). Furthermore, each folding tool has a width d substantially equal to a width w of the formed heat dissipating fin (W=d+2t). Since during formation of the forded fin the machine in accordance with the present invention does not exert any stretching force on webs of the inverted U-shaped heat dissipating fins, theoretically, the folded fin in accordance with the present invention can have an unlimited aspect ratio without breakage occurring to the webs. In a preferred embodiment of the present invention, the folded fin has an aspect ratio between twenty and forty.

To facilitate the folding operation of the machine, a number of pairs of indents can be alternately defined in top and bottom faces of the strip. When the strip is received in the machine and the folding tools clamp the strip at their original position, the first tool clamps the strip between a fist pair of indents in the top face of the strip, the second tool clamps the strip between a successive second pair of indents in the bottom face of the strip, and the third tool clamps the strip between a further successive third pair of indents in the top face of the strip.

To enhance the heat dissipating effectiveness of the folded fin, when defining the indents in the strip, a number of slits can be defined between adjacent pairs of indents. The slits are defined parallel to the indents, whereby when the folded fin is formed a number of horizontal louvers are defined in the webs of the heat dissipating fins.

Alternatively, a wave-like structure can be formed between adjacent pairs of indents having peaks which are parallel to the indents whereby the folded fin is formed with the wave-like structure on the webs of the heat dissipating fins.

DETAILED DESCRIPTION OF THE PREFERRED EMBODIMENTS

Reference will now be made in detail to the preferred embodiments of the present invention.

Figure 2:
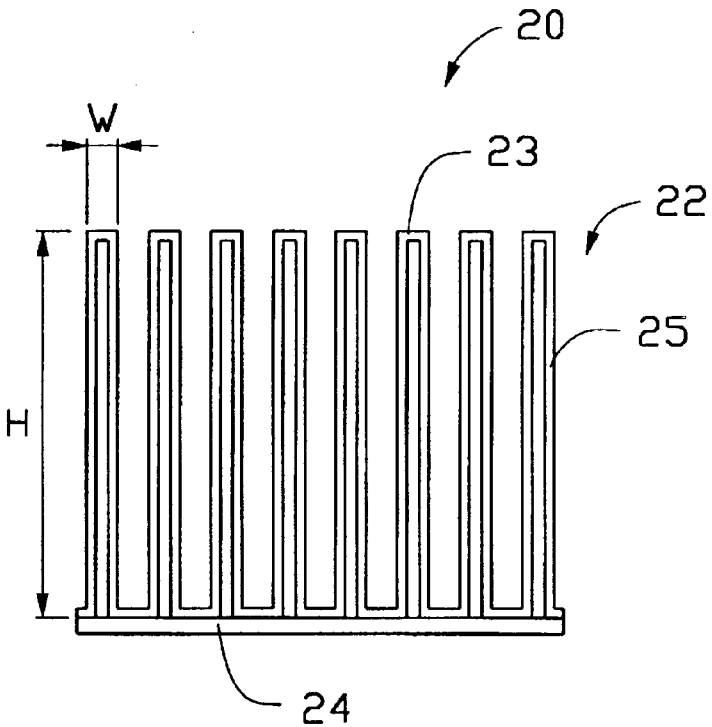
FIG.2 (PRIOR ART)
FIG. 2 is a side elevational view of a second conventional heat sink.
Figure 1:
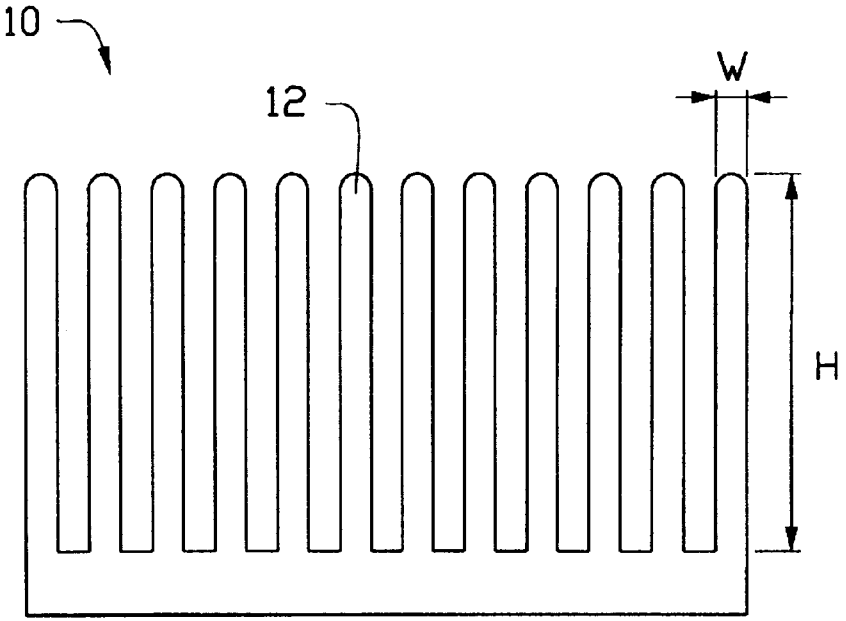
FIG.1 (PRIOR ART)
FIG. 1 is a side elevational view of a first conventional heat sink.
Figure 3:
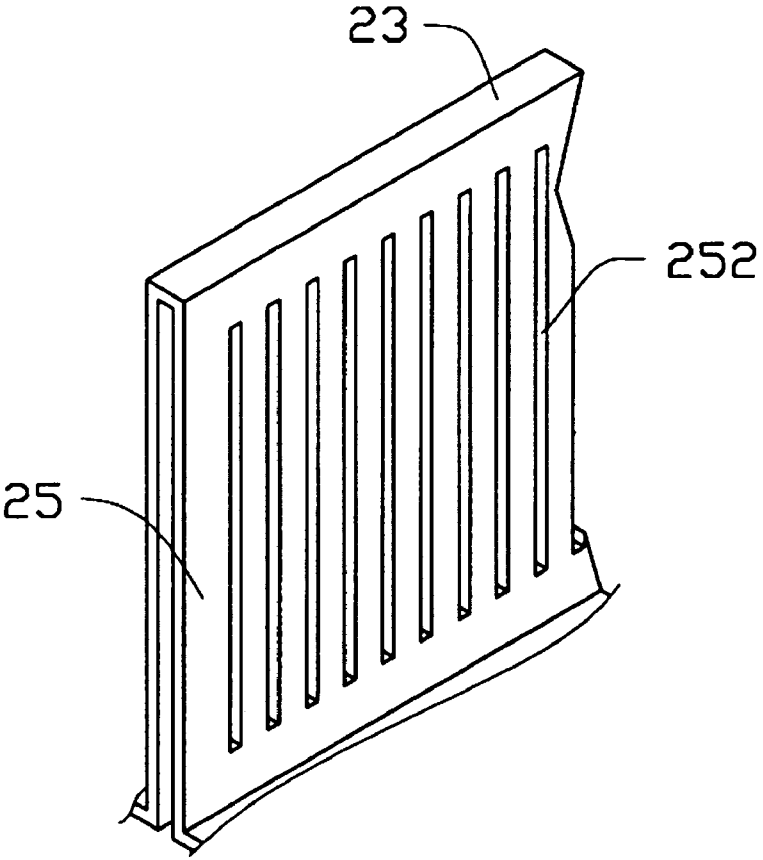
FIG.3 (PRIOR ART)
FIG. 3 is a partial perspective view of a heat dissipating fin of a conventional folded fin made by roll forming.
Figure 4:
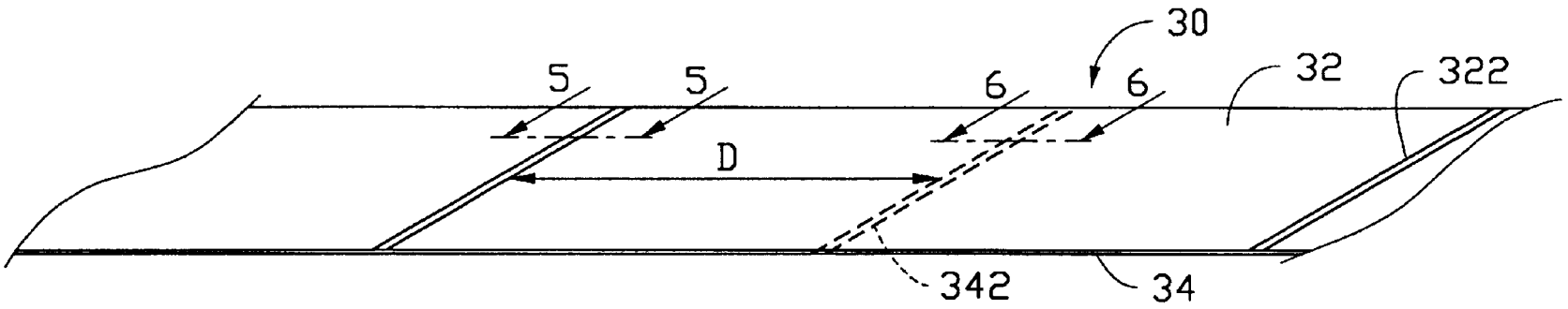
FIG. 4 is a partial perspective view of an aluminum strip for forming a folded fin in accordance with a first embodiment of the present invention.
Figure 5:
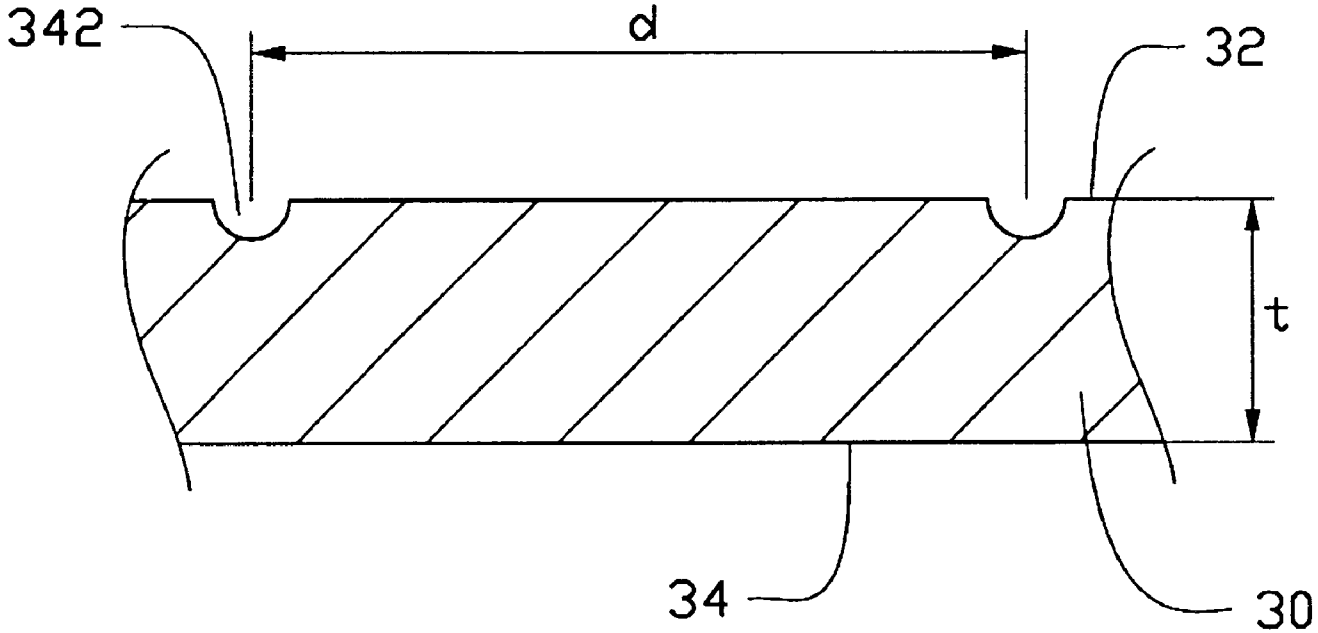
FIG. 5 is a cross-sectional view taken alone line 5—5 of FIG. 4.
Figure 6:
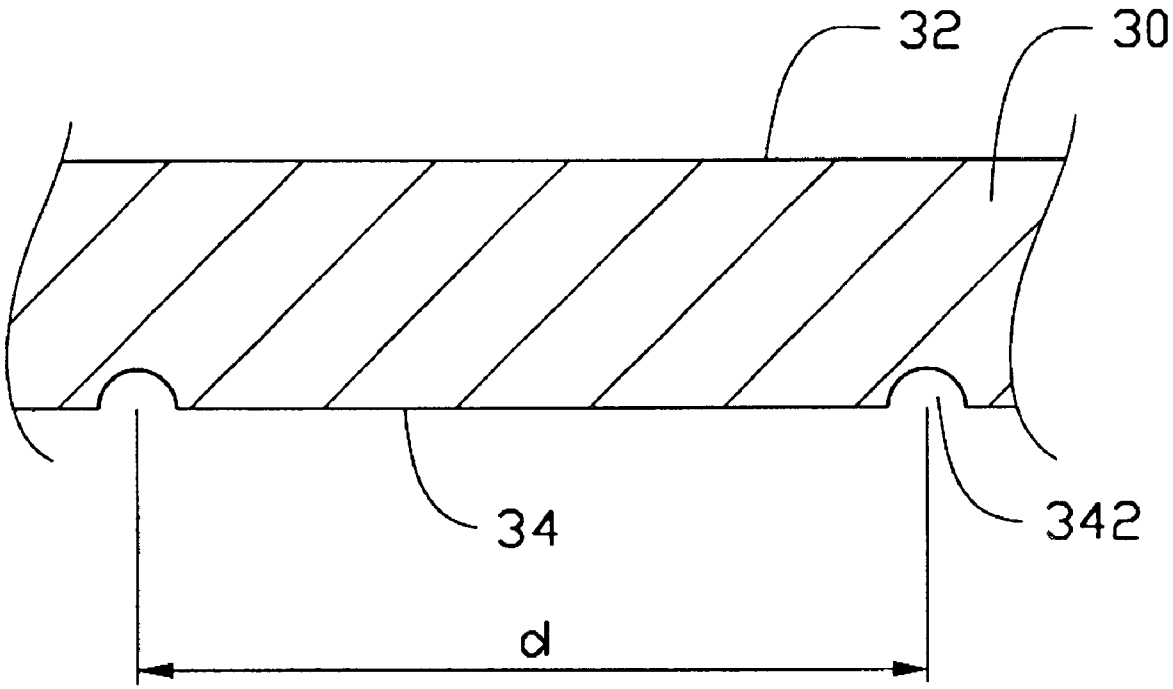
FIG. 6 is a cross-sectional view taken along line 6—6 of FIG. 4.

Referring to FIGS. 4 to 6, an aluminum strip 30 to be folded by a machine in accordance with the present invention alternatively defines a number of pairs of indents 322, 342 in top and bottom faces 32, 34 thereof. The indents 322, 324 are devised to ensure that when the aluminum strip 30 is bent, each corner between a horizontal wall and a corresponding bent vertical wall is right-angled. A distance d between two indents of each pair of indents substantially determines a width w of an inverted U-shaped heat dissipating fin to be formed. The width w is actually equal to the distance d plus two times a thickness t of the strip 30. The distance d is substantially equal to a width of a folding tool used with the machine. A distance D between two adjacent pairs of the indents substantially determines a height H of a folded fin to be formed. The height H of the folded fin is equal to the distance D plus two times the thickness t of the strip 30. The distance D is equal to a distance between two neighboring folding tools when the machine is at an original position. Detailed explanations concerning this are given below.

Referring to FIGS. 7 to 15, a folding machine 40 in accordance with the present invention includes a stationary frame 42, a locating device 43, a folding tool carrier 44 horizontally and reciprocally mounted on the frame 42, and three folding tools 47, 48, 49 drivably mounted on the carrier 44. The first tool 47 is located the farthest away from the locating device 43, the third tool 49 is located closest to the locating device 43, and a second tool 48 is located between the first and third tools 47, 49. Each tool 47, 48, 49 includes an upper clamping block 472, 482, 492 and a lower clampingblock 474, 484, 494, respectively.

Figure 7:
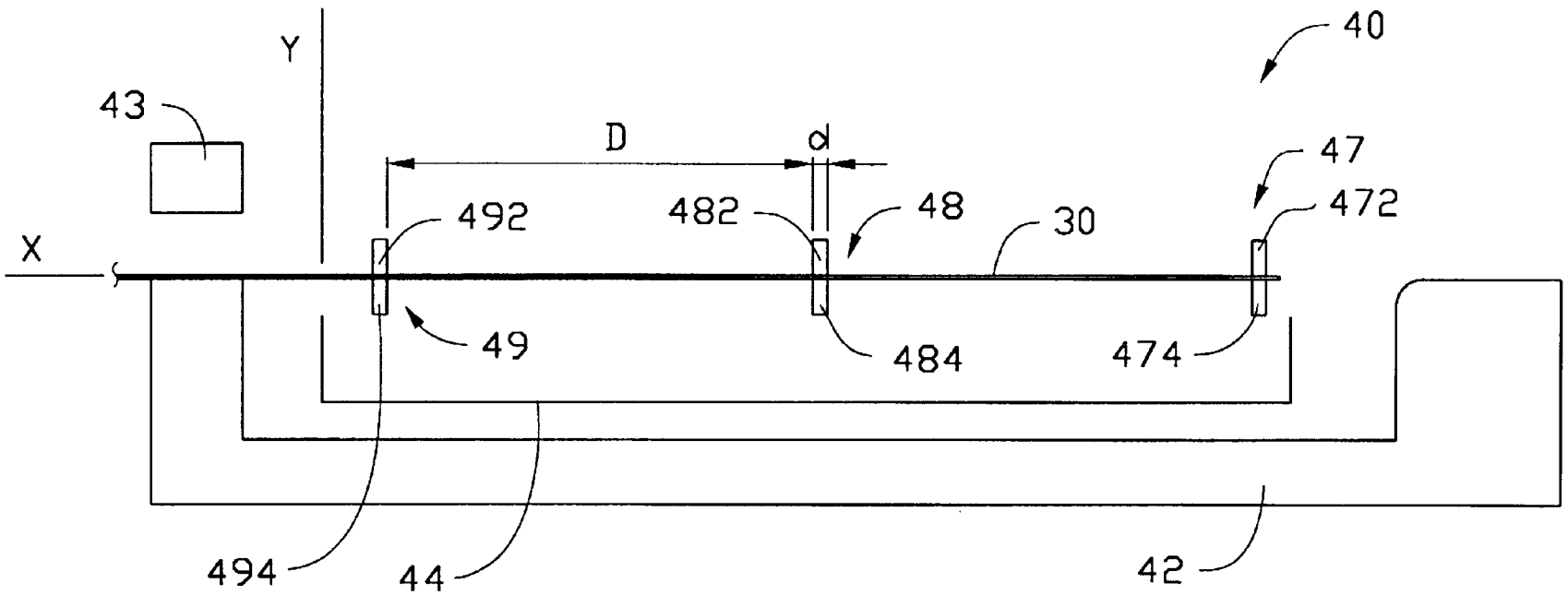
FIG. 7 is a diagrammatic view of a folded fin forming machine in accordance with the present invention with the aluminum strip of FIG. 4 received therein at an original position to be folded by the machine.

To form the folded fin in accordance with the present invention, firstly, the aluminum strip 30 is inserted in the machine 40 a predetermined length by a feeding machine (not shown) which is well known by those skilled in the art and is irrelevant to the inventive features of the present invention, hence, a detailed description thereof is omitted herein. The strip 30 is fed into the machine 40 to a position where the first and third folding tools 47, 49 align with two adjacent pairs of indents 322 in the top face 32 of the strip 30 and the second folding tool 48 aligns with a pair of the indents 342 in the bottom face 34 of the strip 30. Thereafter, the three tools 47, 48, 49 are driven to tightly clamp the strip 30. The locating device 43 is at a released state and does not fix the strip 30 to the frame 42 (FIG. 7). Hereafter, this position is referred to as an original position of the machine 40.

Figure 8:
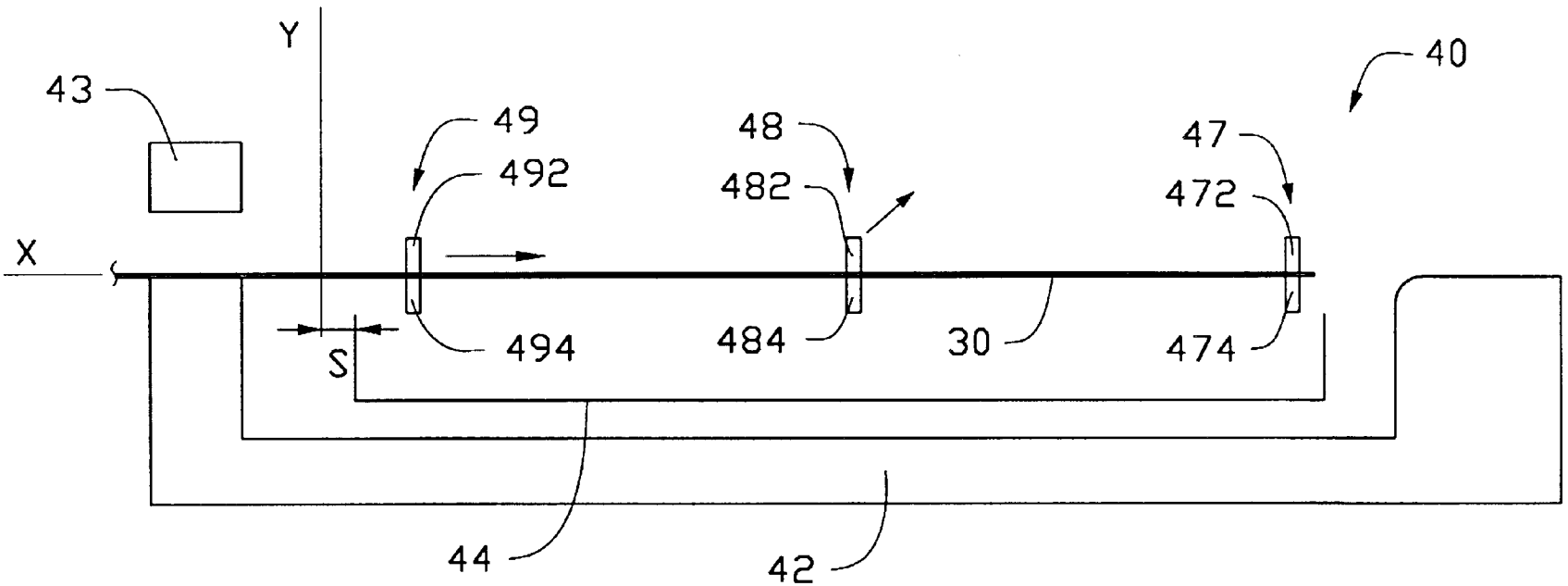
FIG. 8 is a view similar to FIG. 7 with the machine at a second position.

Thereafter, the carrier 44 displaces the three folding tools 47, 48, 49 a distance S to the right. In the preferred embodiment, the distance S is equal to a sum of the width W of the heat dissipating fin to be formed plus the width d of the tool (S=W+d). Then, the second tool 48 moves at an angle toward an upper side of the first folding tool 47, and the third tool 49 moves horizontally toward the first tool 47 to begin folding of the strip 30 (FIG. 8).

Figure 9:
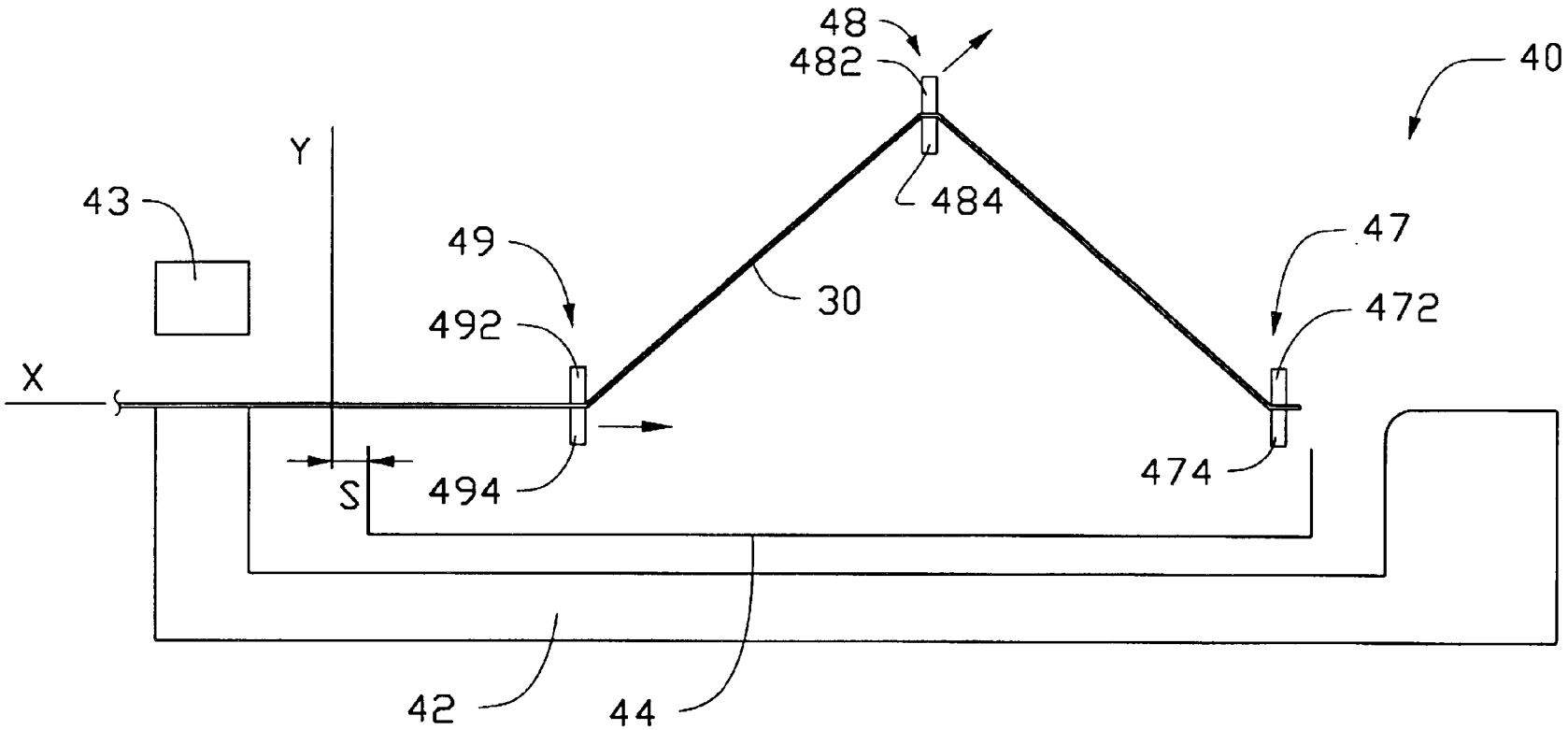
FIG. 9 is a view similar to FIG. 7 with the machine between the second position and a third position.

As shown in FIG. 9, during movement of the second and third folding tools 48, 49, sections (not labeled) of the strip 30 between the first and second tools 47, 48 and the second and third tools 48, 49 are folded to be webs of the heat dissipating fin. The distance between two neighboring tools (which is substantially equal to the distance D between adjacent pairs of indents) substantially determines the height H of the heat dissipating fin.

Figure 10:
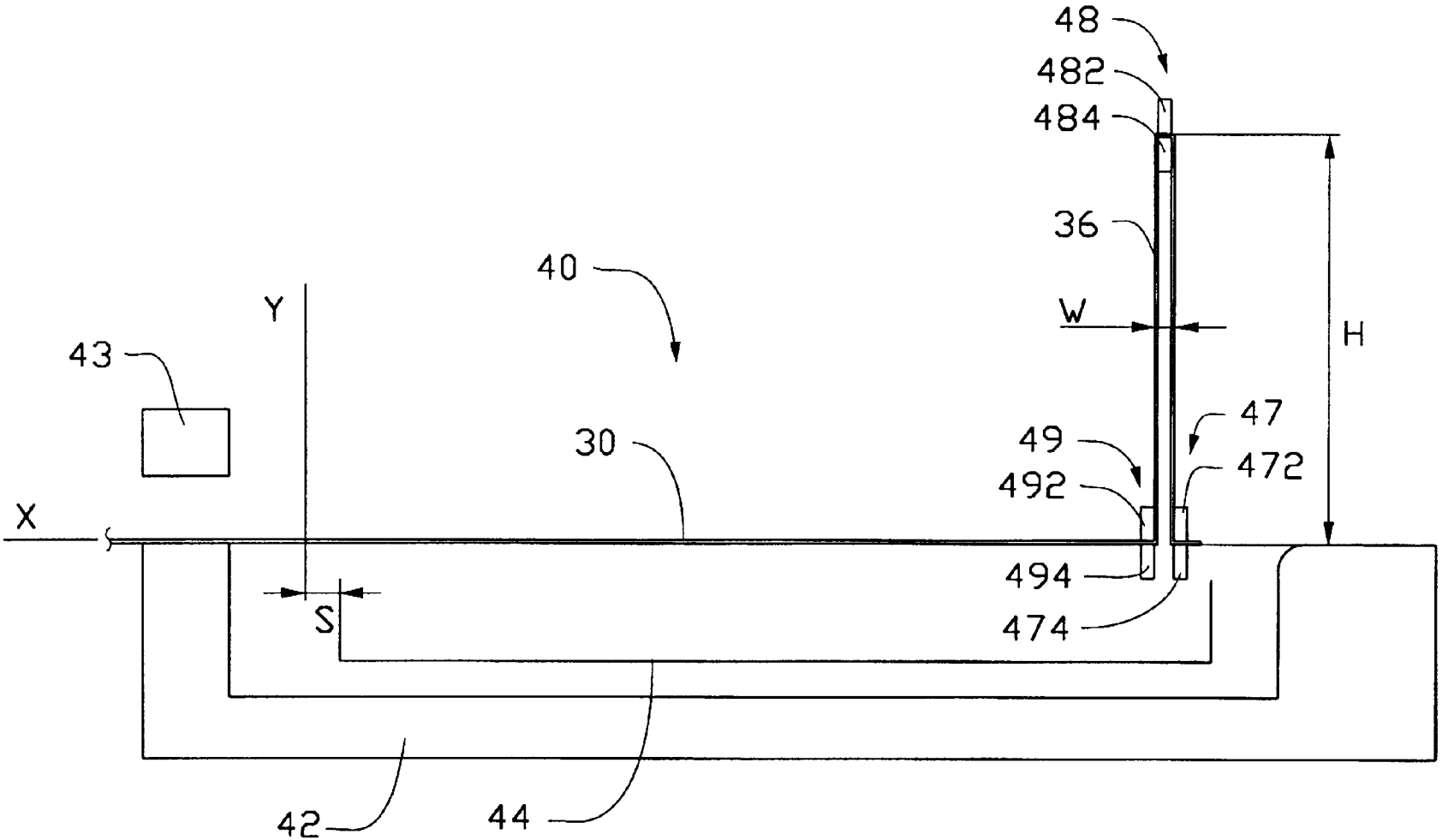
FIG. 10 is a view similar to FIG. 7 with the machine at the third position.

The second tool 48 is moved to a position just to the left of the first tool 47 and spaced therefrom a distance equal to t plus d. The third tool 49 is moved to a position just to the left of the second tool 48 and spaced from the first tool a distance equal to d plus W (FIG. 10).

By the movement of the second and third tools 48, 49, a heat dissipation fin 36 is formed having a height H and a width W wherein as aspect ratio (H/W) can be larger than twelve and is preferably between twenty and forty. In the machine 40 of the present invention, the movement of the second and third folding tools 48, 49 during formation of the heat dissipating fin 36 does not stretch the strip 30 so that the thickness t of the strip 30 remains constant and the webs (not labeled) of the heat dissipating fins 36 will not break. Moreover, by the provision of the indents 322, 342 in the top and bottom faces 32, 34 of the strip 30, the strip 30 can be easily deformed and maintained at the formed shape without rebounding which often occurs when applying a bending operation to a metal plate. Thus, each corner o the folded fin formed by the present machine 40 is right angled and top and bottom faces of the folded fin lie along the same plane to enable the folded fin to be readily and precisely attached to a base plate (not shown) and have a maximum contacting area therewith.

Figure 11:
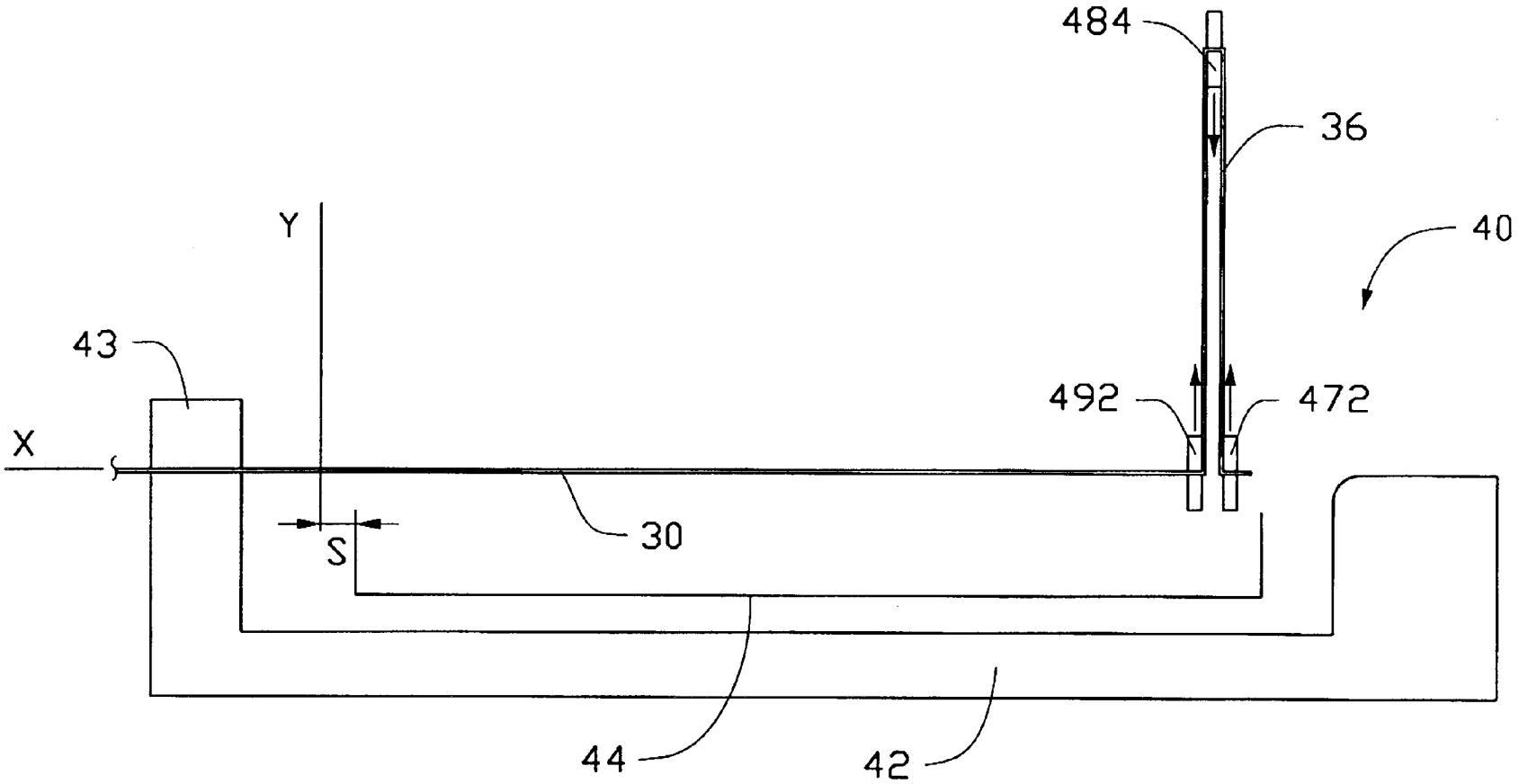
FIG. 11 is a view similar to FIG. 7 with the machine between the third position and a fourth position.
Figure 12:
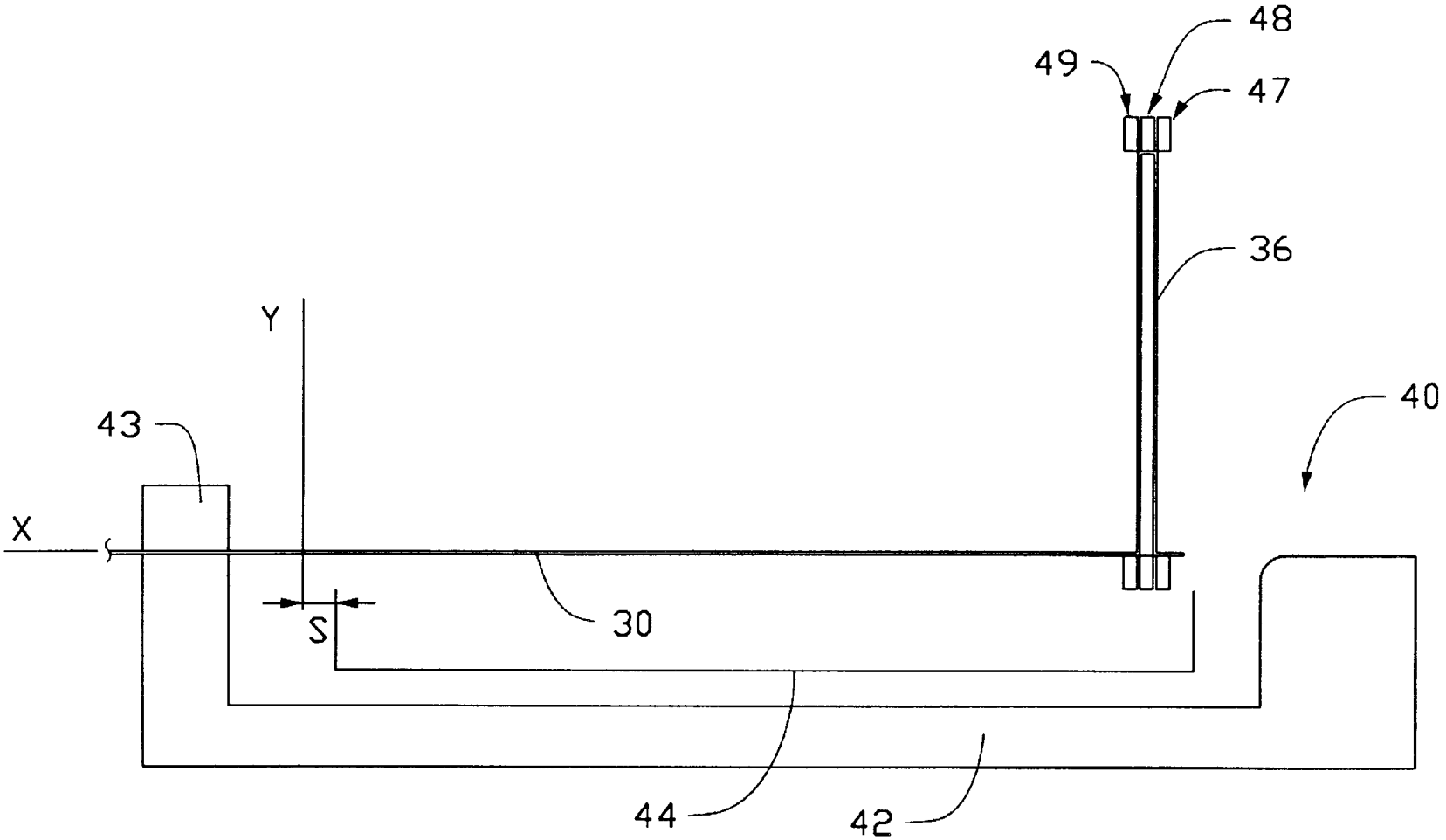
FIG. 12 is a view similar to FIG. 7 with the machine at a fourth position.

After the formation of one inverted U-shaped heat dissipating fin 36, as shown in FIGS. 11 and 12, the locating device 43 is driven to fix the strip 30 to the frame 42. The upper blocks 472, 492 of the first and third folding tools 47, 49 move vertically upward above the formed heat dissipating fin 36. The lower block 484 of the second folding tool 48 moves vertically downward below the formed heat dissipating fin 36.

Figure 13:
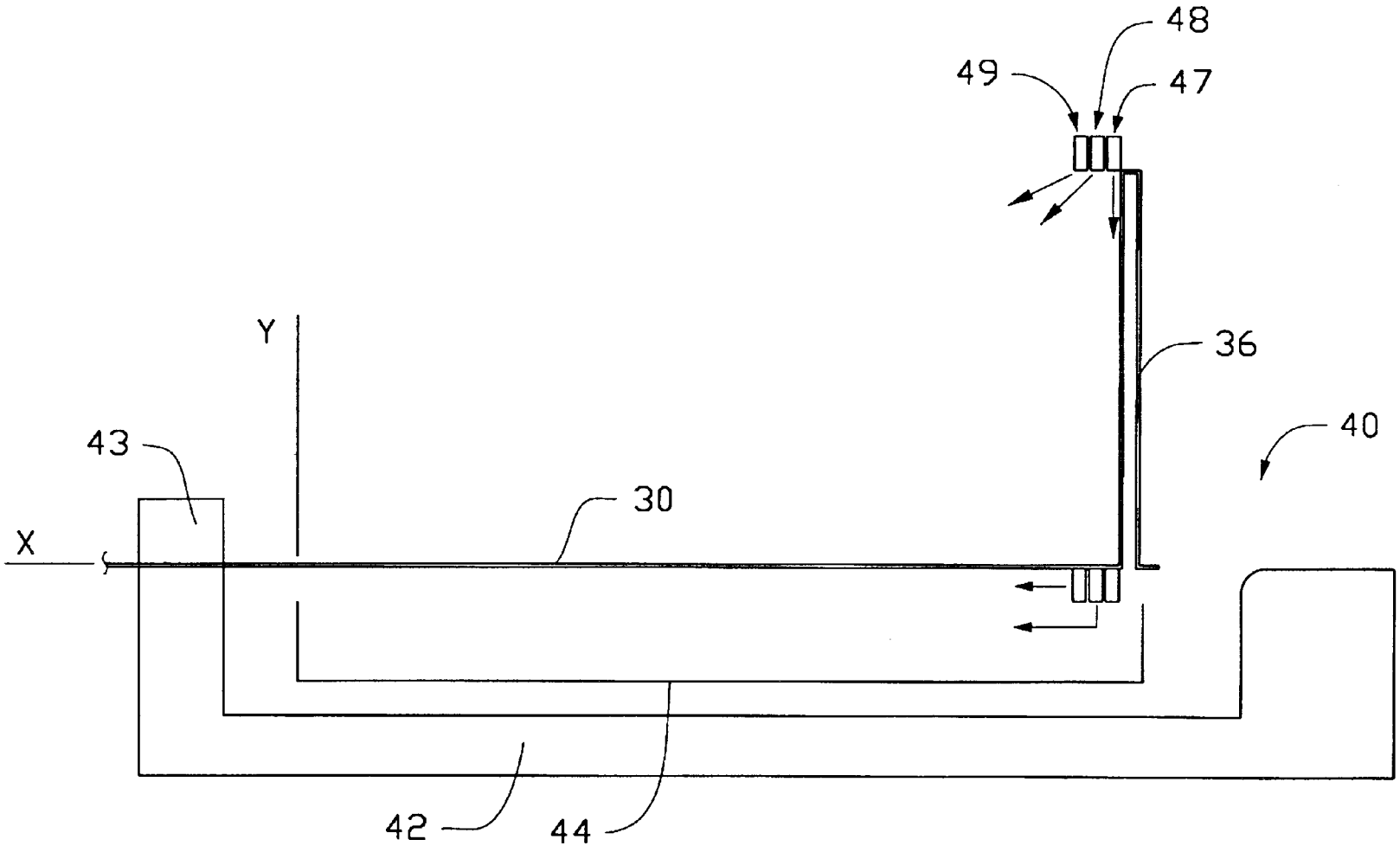
FIG. 13 is a view similar to FIG. 7 with the machine at a fifth position.
Figure 14:
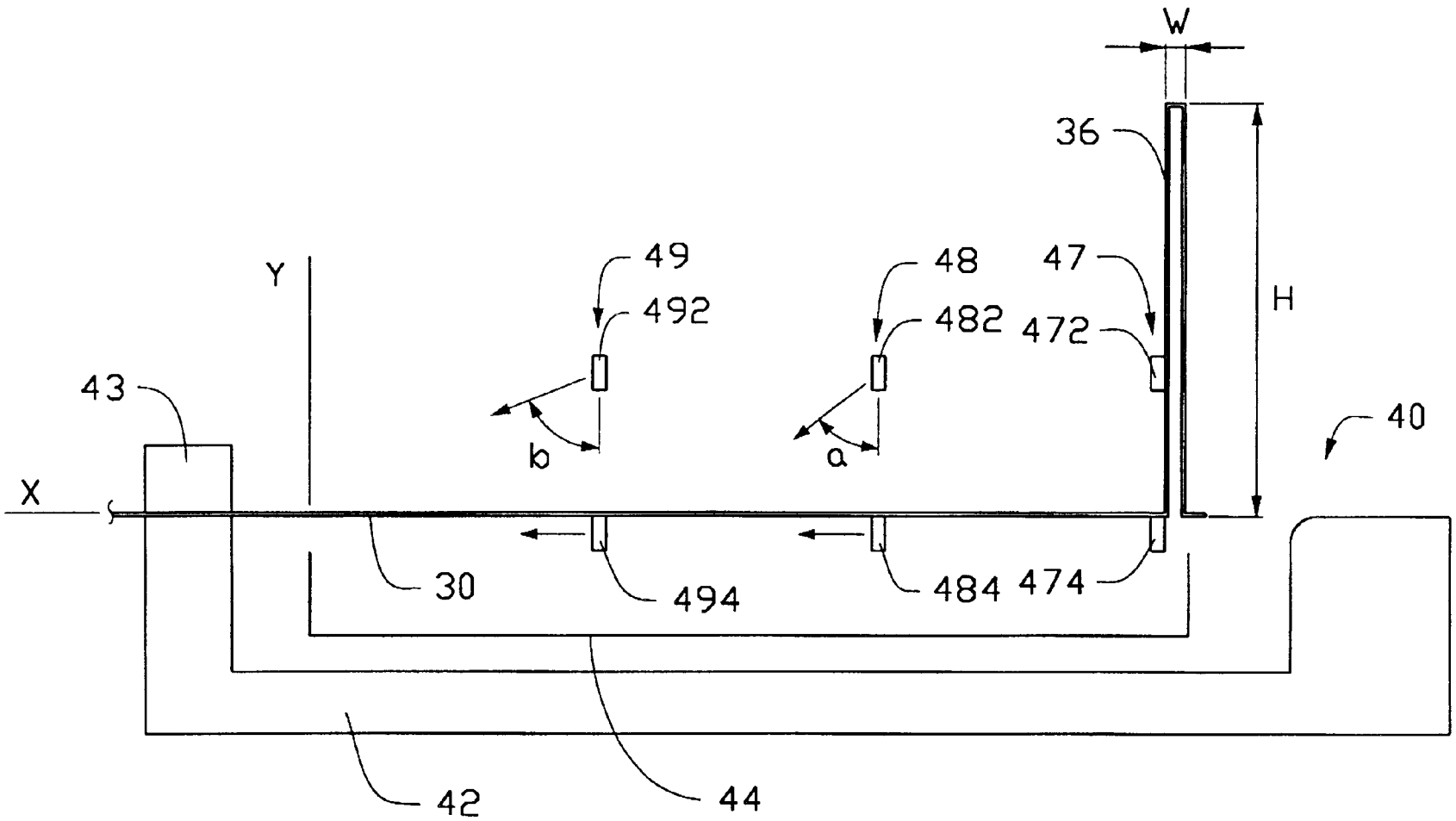
FIG. 14 is a view similar to FIG. 7 with the machine between the fifth position and the first position.
Figure 15:
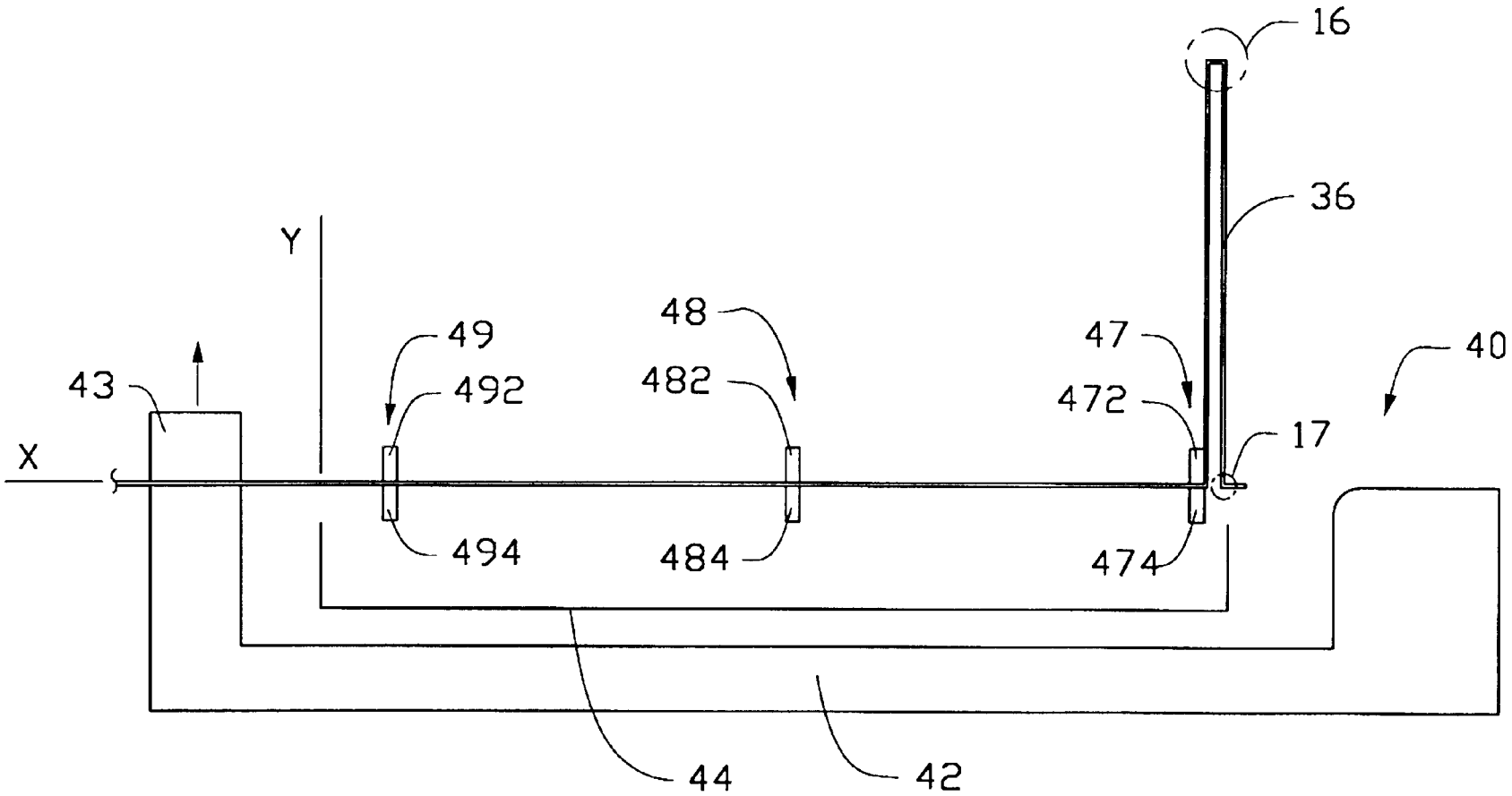
FIG. 15 is a view similar to FIG. 7 with the machine at the first position.

Thereafter, as shown in FIGS. 13 to 15, the carrier 44 displaces the three tools 47, 48, 49 toward the left a distance S. The upper block 472 of the first tool 47 moves vertically downward to cooperate with the lower block 474 thereof to fixedly clamp the strip 30. The lower block 484 of the second tool 48 moves horizontally to return to its original position, and the upper block 482 thereof moves downwardly to the left at an angle "a" to cooperate with the lower block 484 of fixedly clamp the strip 30. The lower block 494 of the second tool 49 moves horizontally to return to its original position, and the upper block 492 thereof moves downwardly to the left at an angle "b" to cooperate with the lower block 494 to fixedly clamp the strip 30. The angle "b" is larger than the angle "a". Finally, the locating device 43 releases its grip on the strip 30 and the machine 40 repeats its operation as depicted from FIGS. 7 to 15 to form successive inverted U-shaped heat dissipating fins 36 on the strip 30 thereby forming the folded fin.

In the present invention, since each block of the folding tools 47, 48, 49 has only a small contact area with the strip 30, the separation of the folding tools from the heat dissipating fin 36 will not exert a stretching force on the webs of the fin 36. Therefore, the machine 40 in accordance with the present invention will not cause the fin 36 to break even if it has a relatively large aspect ratio.

From the above the descriptions it can be seen that the folding method and machine of the present invention is totally different from the teaching of the prior at. A folded fin with a high aspect ratio can be obtained without breaking the webs of the heat dissipating fins 36. Thus, the present invention qualifies to be granted a patent.

Theoretically, if the machine 40 has a sufficiently large size, a folded fin can be produced without limitation of the aspect ratio. Nevertheless, the folded fin manufactured by the present machine 40 preferably has an aspect ratio between twenty and forty.

Figure 17:
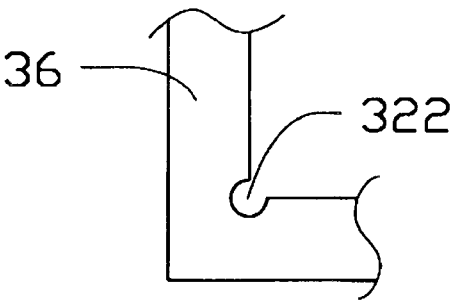
FIG. 17 is a partially enlarged view of circle 17 as shown in FIG. 15.
Figure 16:
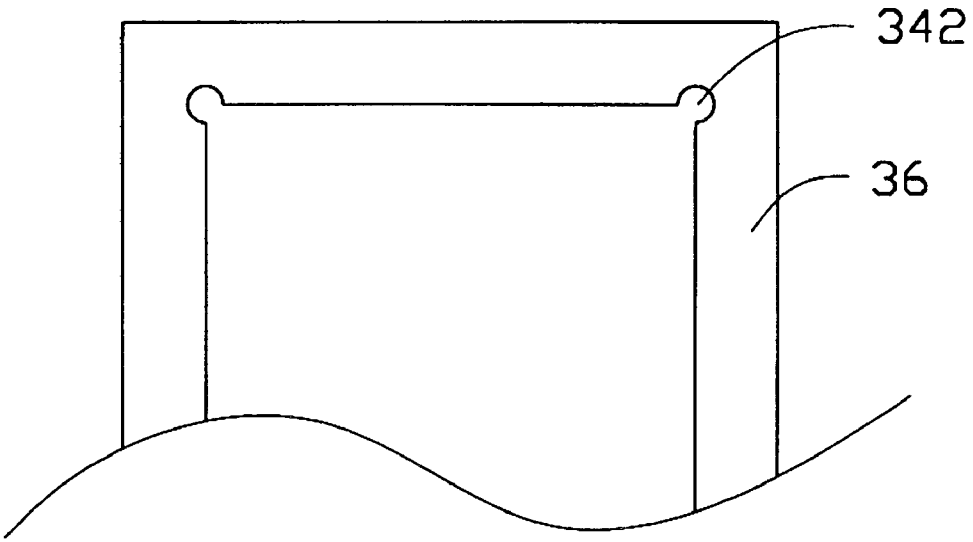
FIG. 16 is a partially enlarged view of circular 16 as shown in FIG. 15.

FIGS. 16 and 17 show that the provision of the indents 322, 343 in the top and bottom faces 32, 34 of the strip 30 provides as inside of each comer of the folded fin with sufficient clearance for proper folding. Such a design not only guarantees the corresponding comer to be formed at a perfect right angle, but also eliminates an internal stress within the corner due to the bending operation, whereby the folded fin can maintain its formed configuration without subsequent deformation.

Figure 18:
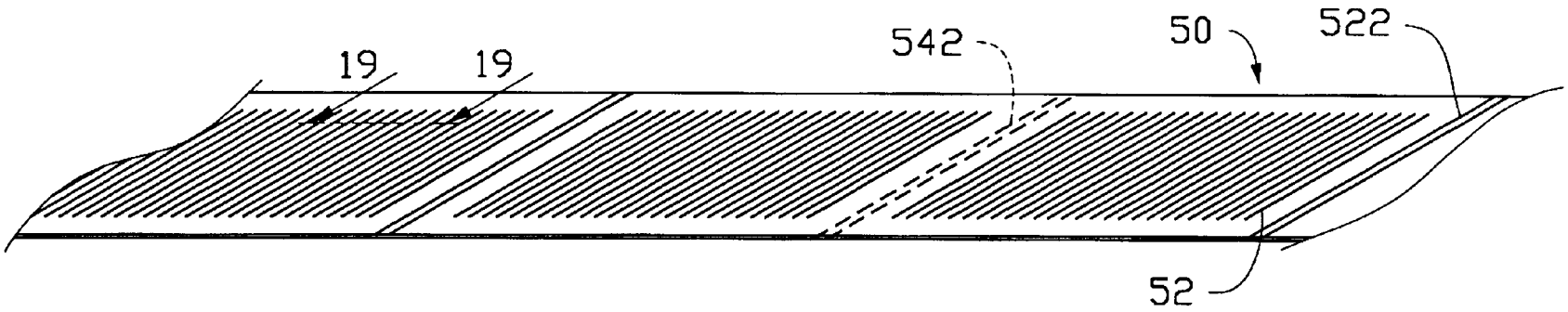
FIG. 18 is a view similar to FIG. 4, showing an aluminum strip for forming a folded fin in accordance with a second embodiment of the present invention.
Figure 19:
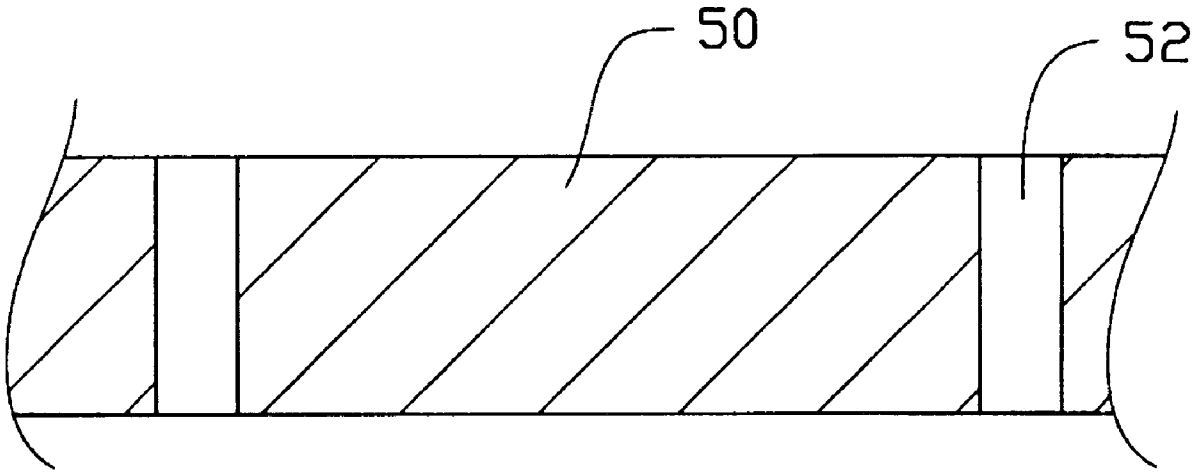
FIG. 19 is cross-sectional view taken along line 19—19 of FIG. 18.
Figure 20:
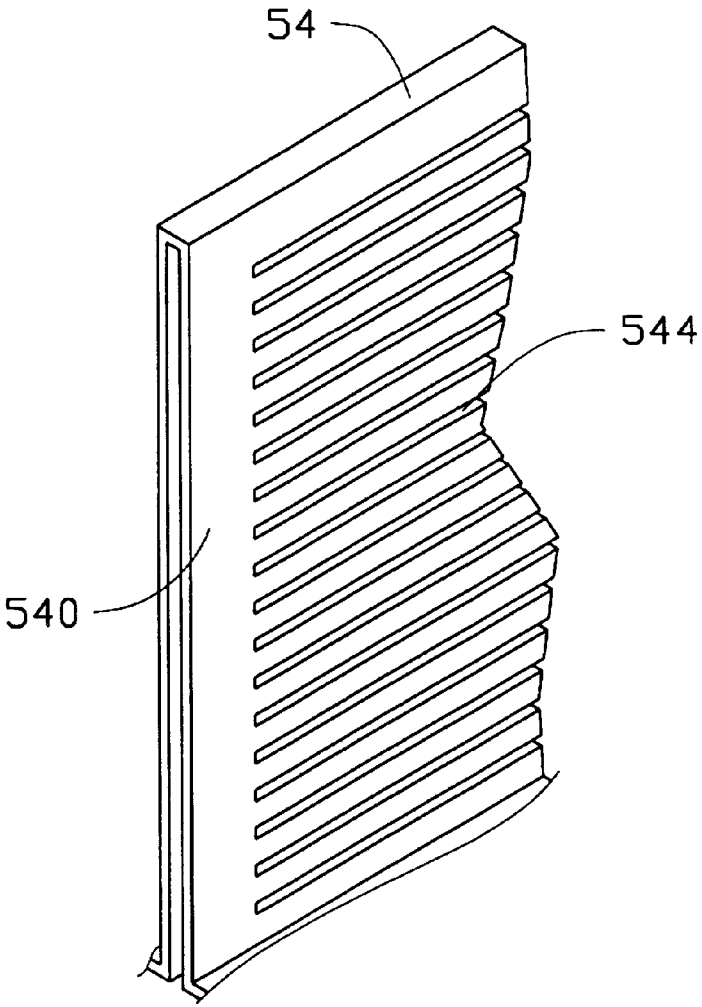
FIG. 20 is a partial perspective view of a heat dissipating fin of a folded fin formed in accordance with the second embodiment of the present invention.

FIGS. 18 to 20 show an aluminum strip 50 used for obtaining a folded fin in accordance with a second embodiment of the present invention. A number of slits 52 are defined in the aluminum strip 50 between adjacent upper and lower indents 522, 542. The slits 52 are defined to be parallel to the indents 522, 524. When the strip 50 is folded by the machine 40 following the operation of FIGS. 7 to 15 to obtain the folded fin, a number of horizontal louvers 544 are formed in upright webs 540 of the heat dissipating fins 54, whereby the heat dissipating effectiveness of the folded fin can be significantly enhanced.

Figure 21:
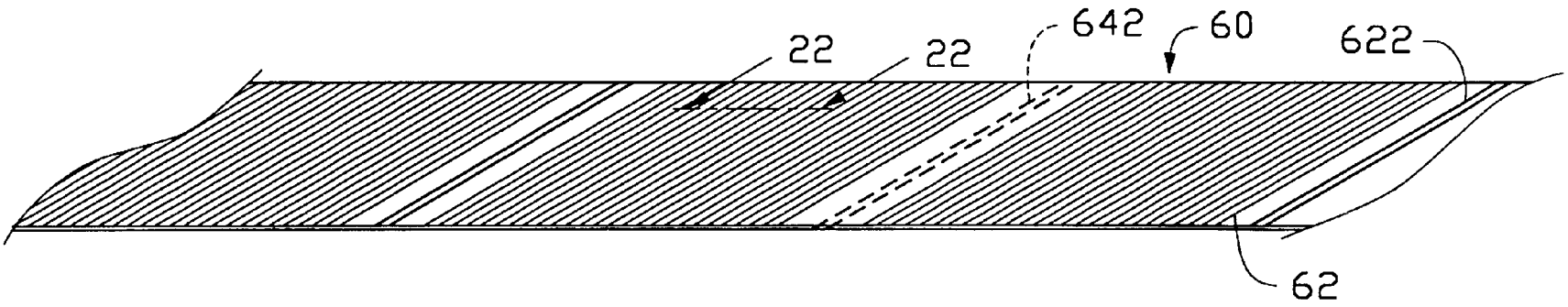
FIG. 21 is a view similar to FIG. 4, showing an aluminum strip for forming a folded fin in accordance with a third embodiment of the present invention.
Figure 22:
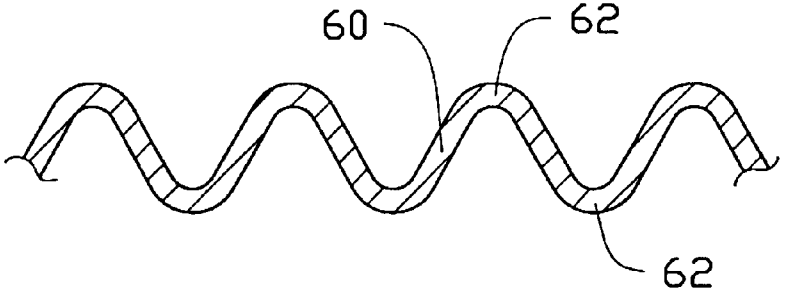
FIG. 22 is a cross-sectional view taken along line 22—22 of FIG. 21.
Figure 23:
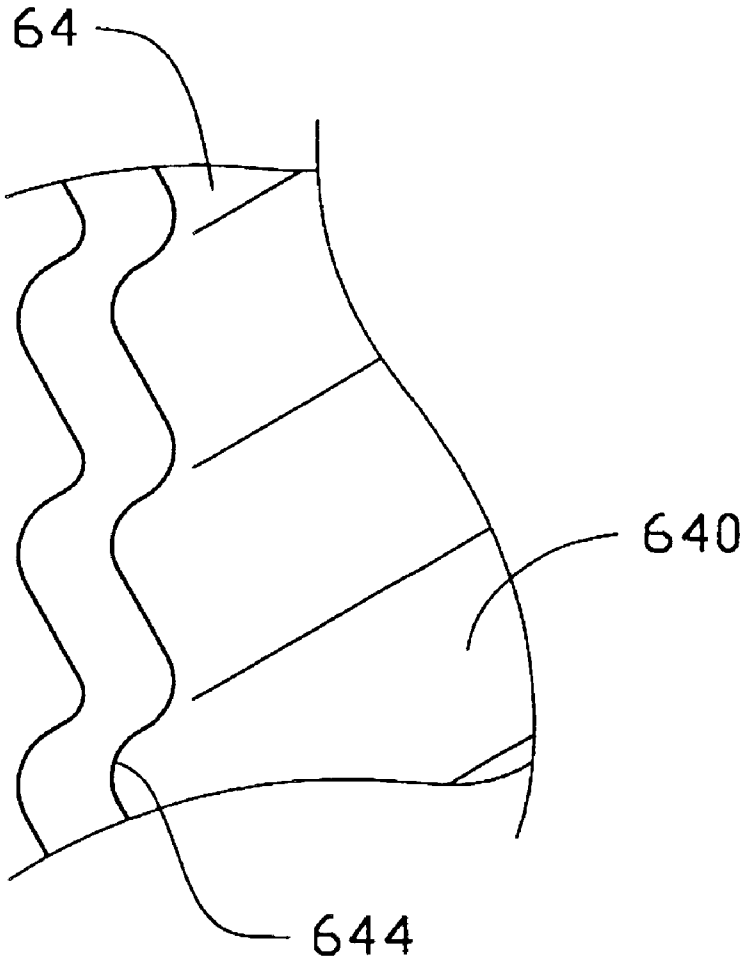
FIG. 23 is a partially enlarged view of a part of a web of a heat dissipating fin of a folded fin formed in accordance with the third embodiment of the present invention.

FIGS. 21 to 23 shows an aluminum strip 60 for obtaining a folded fin in accordance with a third embodiment of the present invention. A wave-like structure 62 is formed on the strip 60 between adjacent upper and lower indents 622, 642. Peaks (not labeled) of the wave-like structure 62 are parallel to the indents 622, 642. When the aluminum strip 60 is subject to a folding operation of the machine 40 to become a folded fin, upright webs 640 of the heat dissipating fins 64 are formed with wavelike structures 644 each having horizontal peaks, whereby the heat dissipating effectiveness of the folded fin can be significantly enhanced.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

We claim:

1. A method for forming a heat dissipating fin, comprising the following steps:

A) providing a horizontal metal strip;

A') forming a number of pairs of indents alternately in top and bottom faces of the strip;

B) using first, second, and third tools, each tool including an upper clamping block and a lower clamping block respectively, for securely clamping the strip, wherein the first tool clamps the strip between a first pair of indents in the top face of the strip, the second tool clamps the strip between a successive second pair of indents in the bottom face of the strip, and the third tool clamps the strip between a further successive third pair of indents in the top face of the strip; and C) moving the second and third tools toward the first tool to a position where sections of the strip between the first and second tools and between the second and third tools become vertical to form a heat dissipating fin.

2. The method in accordance with claim 1, wherein a distance between two adjacent pairs of indents is larger than twelve times a distance between two indents of a pair of indents whereby the formed fin has an aspect ratio larger than twelve.

3. The method in accordance with claim 2, wherein the distance between two adjacent pairs of indents is about twenty to forty times the distance between two indents of a pair of indents whereby the formed fin has an aspect ratio of twenty to forty.

* * * * *